US006719094B2

(12) United States Patent
de la Tour

(10) Patent No.: US 6,719,094 B2
(45) **Date of Patent: *Apr. 13, 2004**

(54) LIMITED MOBILITY LADDER

(76) Inventor: Rene J. de la Tour, 428 Bill Dr., Mandeville, LA (US) 70448

( * ) Notice: Subject to any disclaimer, the term of this patent is extended or adjusted under 35 U.S.C. 154(b) by 0 days.

This patent is subject to a terminal disclaimer.

(21) Appl. No.: 10/446,764

(22) Filed: May 28, 2003

(65) Prior Publication Data

US 2003/0196856 A1 Oct. 23, 2003

Related U.S. Application Data

(63) Continuation of application No. 09/908,933, filed on Jul. 19, 2001, now Pat. No. 6,571,915.

(51) Int. Cl.[7] ..... E04G 1/34; E06C 1/00

(52) U.S. Cl. ..... 182/152; 182/156; 182/159; 297/DIG. 10; 5/81.1 R

(58) Field of Search ..... 182/152, 156, 182/159, 223, 33, 35, 106; 297/42, 43, 44, DIG. 10; 5/81.1 R; 135/65, 66, 67, 71, 72, 76; D25/64, 65

(56) References Cited

U.S. PATENT DOCUMENTS

| | | | | |
|---|---|---|---|---|
| 1,305,281 | A | | 6/1919 | Hall |
| 1,420,095 | A | | 6/1922 | Gutter |
| 2,622,658 | A | | 12/1952 | Morgan |
| 2,793,800 | A | | 5/1957 | Hudd |
| 2,805,703 | A | | 9/1957 | Wise |
| D186,506 | S | | 11/1959 | Rosenberg |
| 3,142,351 | A | | 7/1964 | Green |
| 3,142,355 | A | * | 7/1964 | Danielson ..... 182/106 |
| 3,743,051 | A | | 7/1973 | Cramer |
| 3,811,533 | A | | 5/1974 | Cocker |
| 4,135,605 | A | | 1/1979 | Matherne |
| 4,250,977 | A | | 2/1981 | Deli |
| 5,170,862 | A | | 12/1992 | Chang |
| 5,257,425 | A | | 11/1993 | Shinabarger |
| 5,381,873 | A | | 1/1995 | Kniefel et al. |
| 5,465,744 | A | | 11/1995 | Browning |
| 5,509,152 | A | | 4/1996 | Kippes |
| 6,082,384 | A | | 7/2000 | Cheng |
| 6,571,915 | B1 | | 6/2003 | de la Tour |

FOREIGN PATENT DOCUMENTS

| | | |
|---|---|---|
| GB | 995235 | 6/1965 |

* cited by examiner

*Primary Examiner*—Hugh B. Thompson, II
(74) *Attorney, Agent, or Firm*—Garvey, Smith, Nehrbass & Doody, L.L.C.; Gregory C. Smith

(57) ABSTRACT

A ladder for people with limited mobility comprising a first frame member defining a first sidewall; a second frame member defining a second sidewall; a plurality of steps spanning between the first and second sidewalls, from a first level above the surface to the upper level substantially to the height of a wheelchair seat; handles positioned above each of the steps, so that a person is able to place one's hands on the handles and lift oneself up the first step, and grasp the next highest handles and lift to the next highest step until the person is able to move from the highest step onto the wheelchair seat.

10 Claims, 11 Drawing Sheets

FIG. 3A
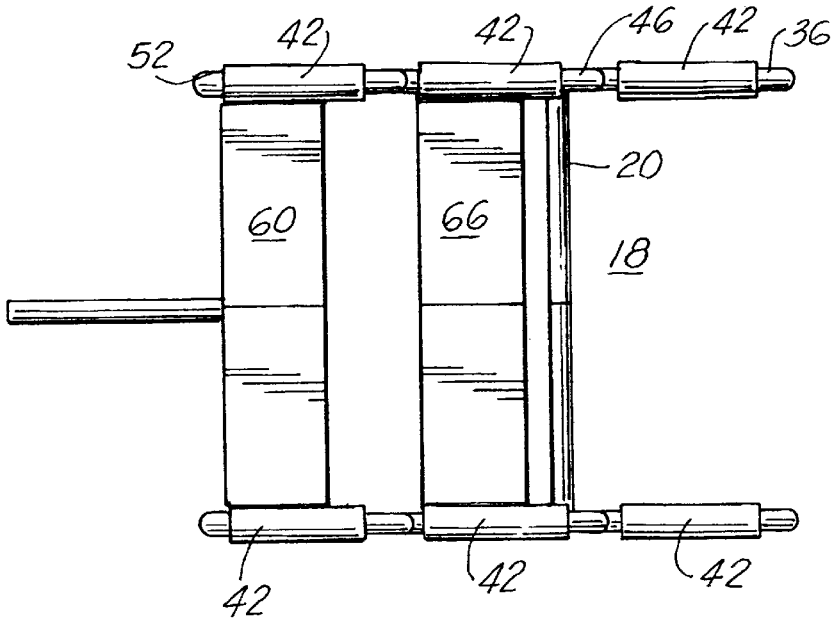
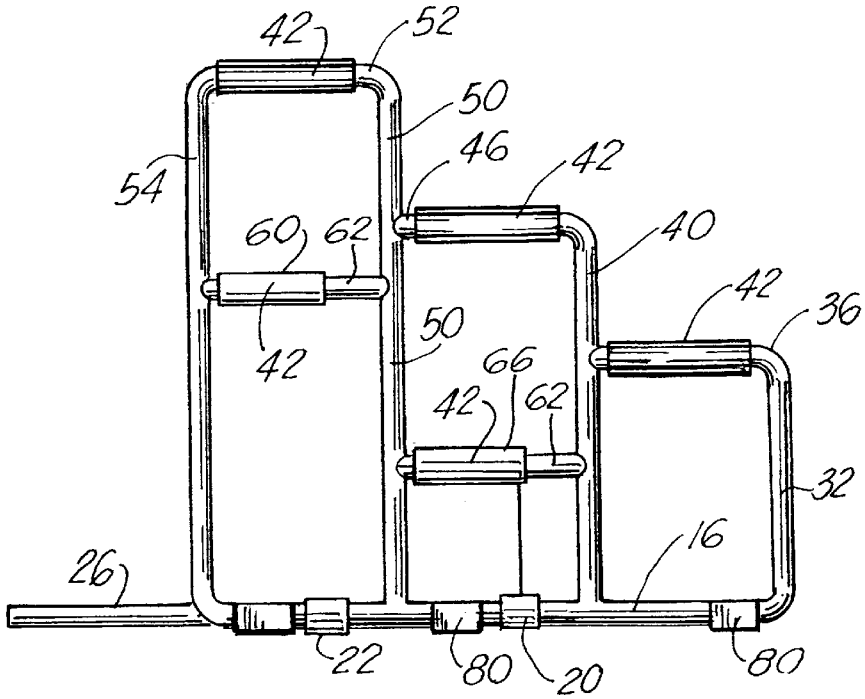
FIG. 4

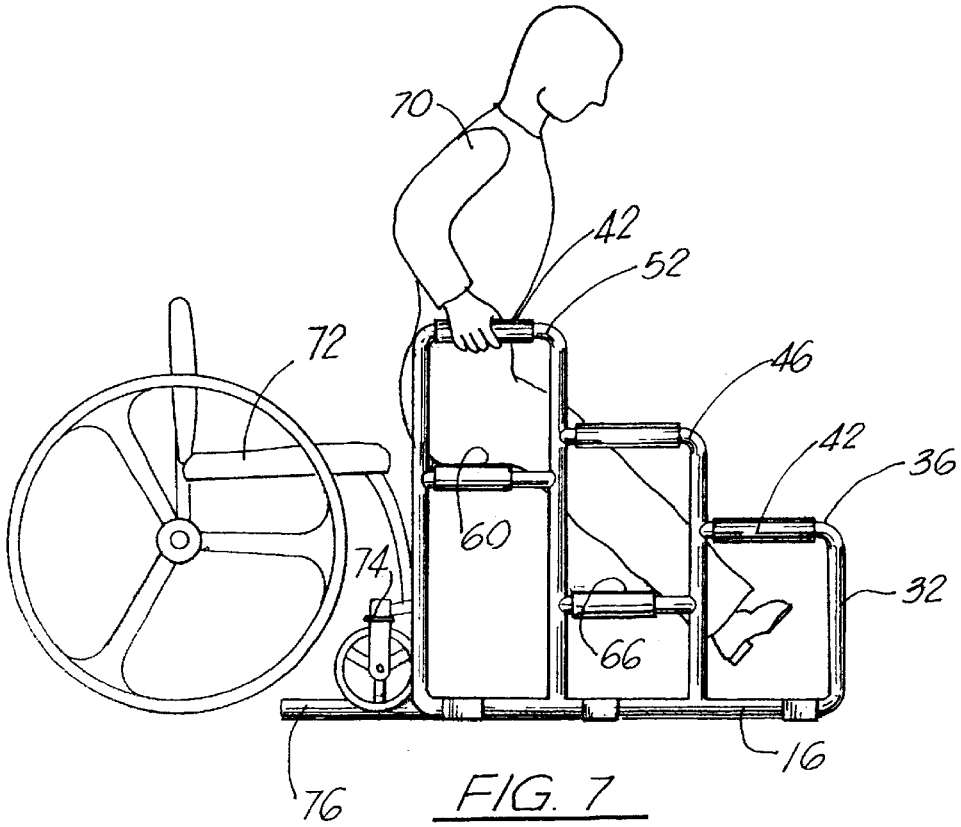
FIG. 7
FIG. 8
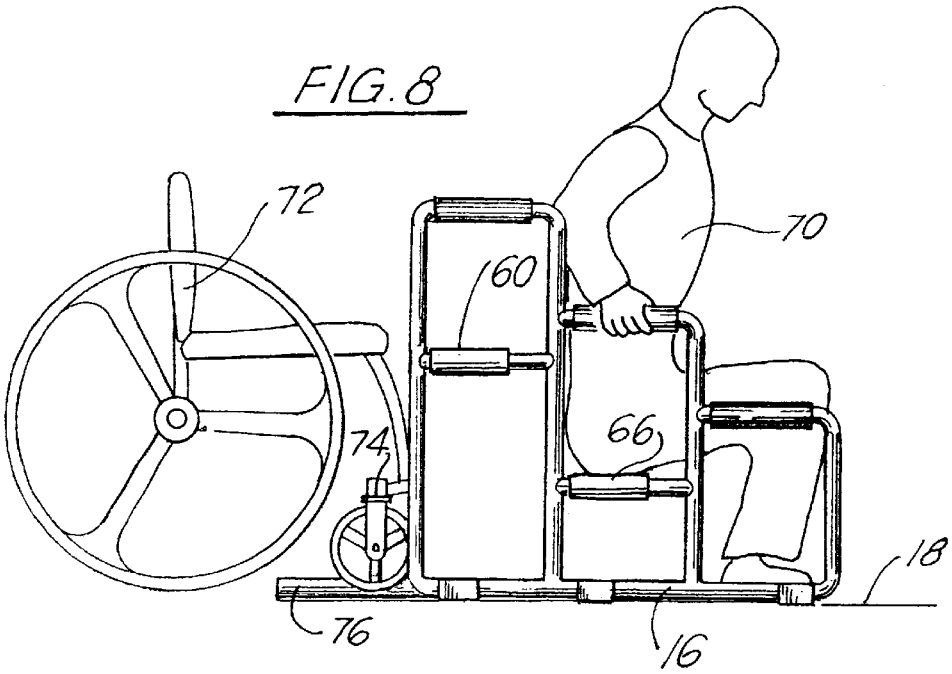

FIG. 11
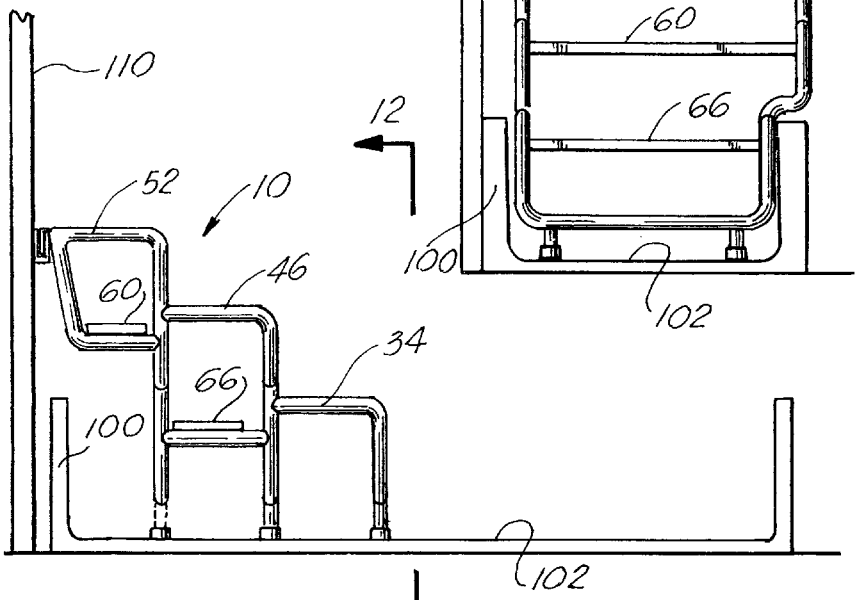
FIG. 12
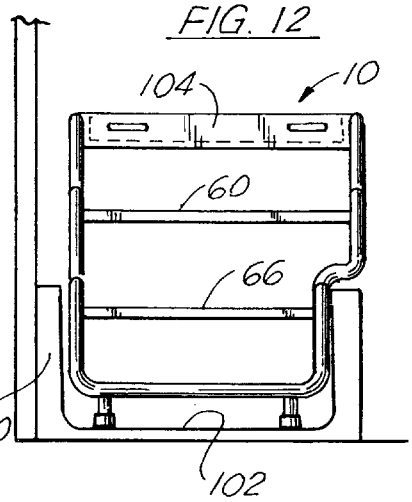
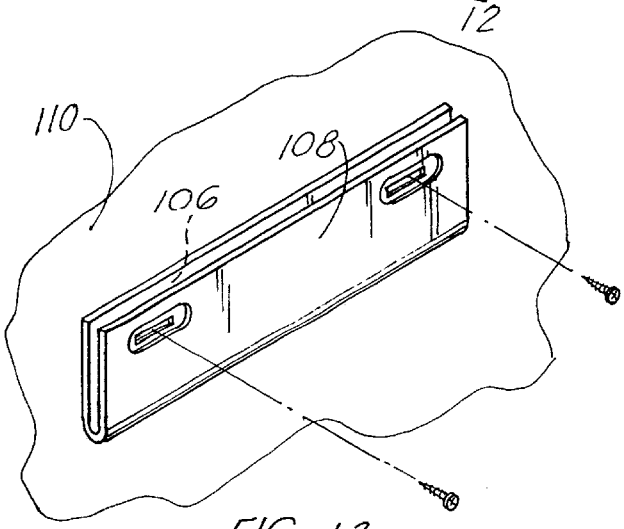
FIG. 13
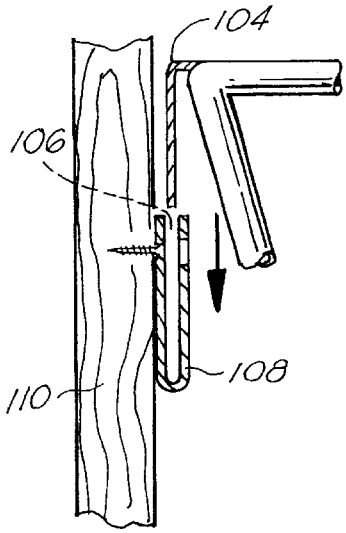
FIG. 14

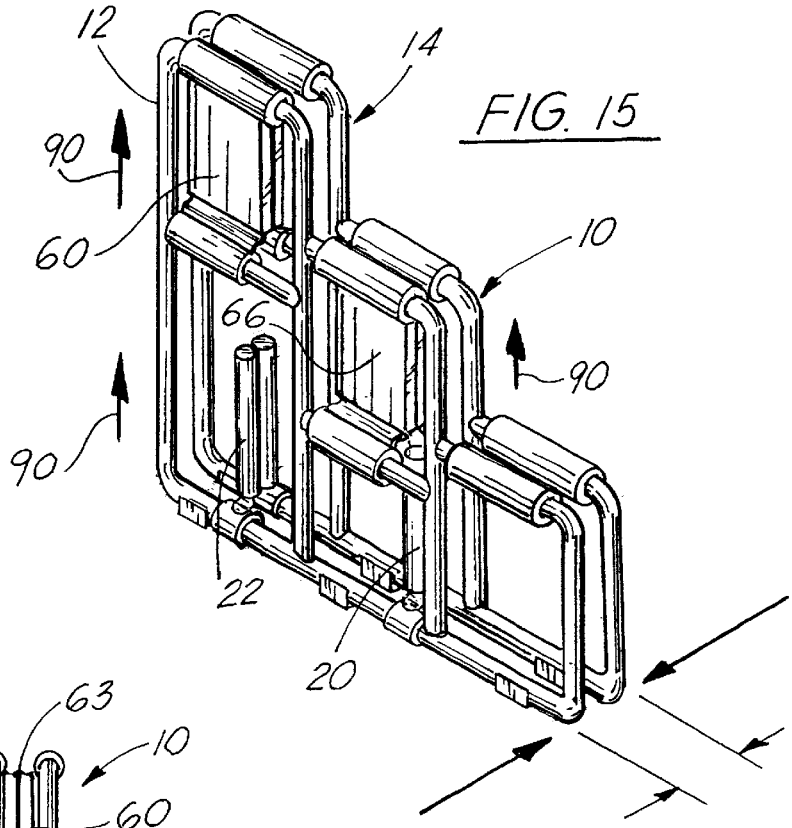
FIG. 15
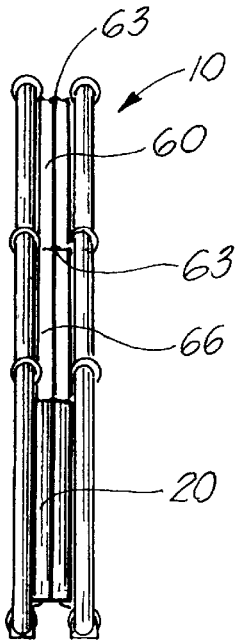
FIG. 16
FIG. 17
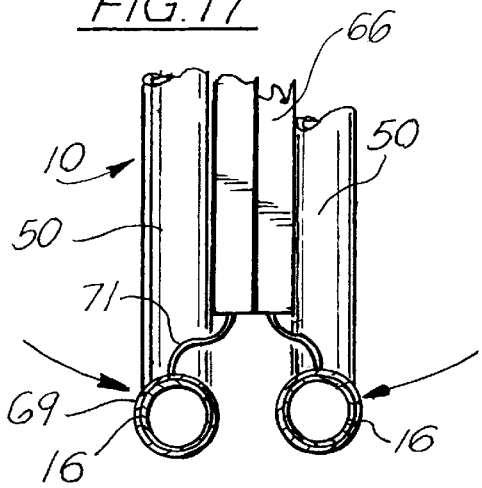

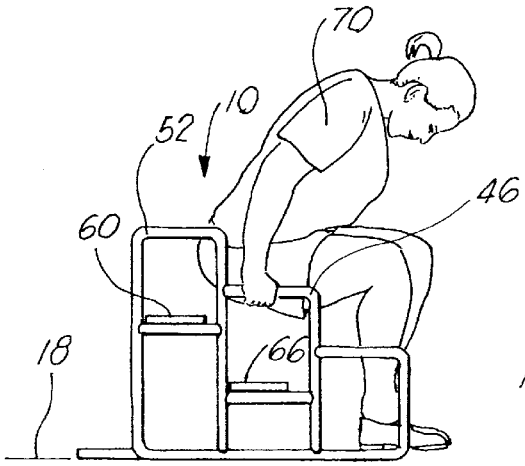
FIG. 21
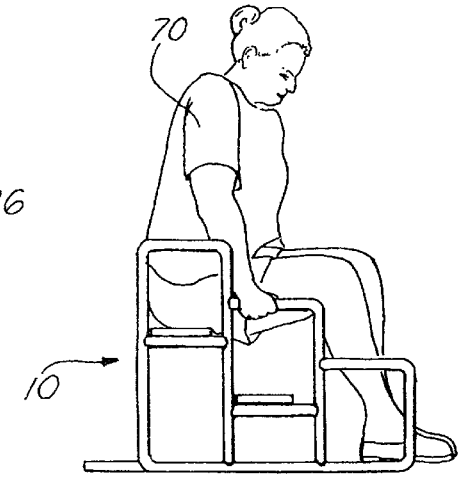
FIG. 22
FIG. 23
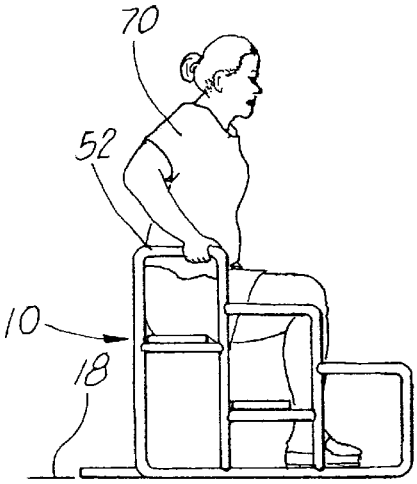
FIG. 24
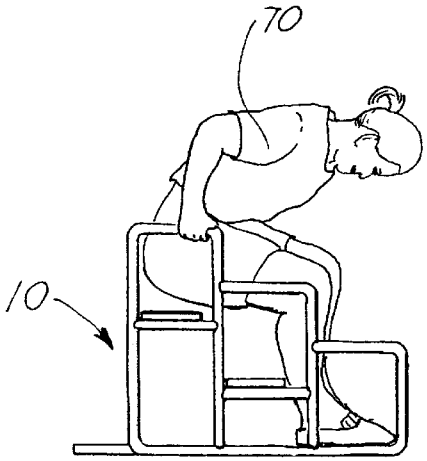

LIMITED MOBILITY LADDER

CROSS-REFERENCE TO RELATED APPLICATIONS

This application is a continuation of U.S. appl. Ser. No. 09/908,933, filed Jul. 19, 2001, now U.S. Pat. No. 6,571,915.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The apparatus of the present invention relates to assisting people with limited mobility. More particularly, the present invention relates to a stepped ladder positionable on a surface to allow a person with limited mobility, such as an elderly person, or a paraplegic, to raise himself from a position seated on the surface up a plurality of steps to a position level with a wheel chair or like apparatus.

2. General Background of the Invention

One of the more difficult problems in care of people is the problem of having a partially mobile person, such as a paraplegic, elderly person, or amputee, to be able to move from a wheel chair to a surface such as the ground or floor without assistance from another person. More critically, there is a problem of such an individual, who may be living or staying alone, confined to a wheelchair, and through an accident, find him or herself having fallen from the chair onto the floor, and has no means in order to lift him or herself back up into the wheelchair. Furthermore, there is the need for a person confined to a wheelchair who may wish to move from the chair to the ground, for example to work in a garden, or simply enjoy sitting on the lawn. If such a person lives alone, there is no means for allowing the person, without the help of another, to move from the chair to the ground safely, and return to the chair when the person so desires. In other instances, some elderly people, although they are not confined to a wheel chair, are simply unable to move from a standing position to a position seated on the floor or ground gradually, due to the weakness in their limbs or rigidity in their joints. For example, if such a person desired to take a bath in a floor level tub, they would be unable to stand in the tub and move to a seated position for fear of injury or great pain.

Such people could benefit greatly from a device which would allow one to move from a wheel chair to the ground or floor and return to the chair, or to move from a standing position, and gradually move to a seated position, and return to a standing position without fear of pain or injury.

BRIEF SUMMARY OF THE INVENTION

The apparatus of the present invention solves the problems in the art in a simple and straightforward manner. What is provided is a ladder for people with limited mobility comprising a first frame member defining a first sidewall; a second frame member defining a second sidewall; a plurality of steps spanning between the first and second sidewalls, from a first level above the surface to the upper level substantially to the height of a wheelchair seat; handles positioned above each of the steps, so that a person is able to place one's hands on the handles and lift oneself up the first step, and grasp the next highest handles and lift to the next highest step until the person is able to move from the highest step onto the wheelchair seat. There is further provided a means for allowing each of the steps to fold upwardly along their midpoint to move the apparatus into a folded storage position when not in use.

Therefore, it is a principal object of the present invention to provide a limited mobility ladder for allowing a person to move from a wheel chair, onto the upper step of the ladder and to move down the steps so that one is able to be seated on the ground or floor;

It is a further object of the present invention to provide a limited mobility ladder to allow a person to move up and down a plurality of steps of the ladder by raising oneself up or down the steps through the use of upper limbs only;

It is a further object of the present invention to provide a limited mobility ladder which may be placed in a bathtub and allow a person of limited mobility to move from a standing position down the various steps so as to be seated in the tub and return to the seated position for standing and exiting the tub.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein:

FIGS. 3A and 3B illustrate top and bottom views respectively; a

FIG. 4 illustrates a side view of the preferred embodiment of the apparatus of the present invention;

FIGS. 5 through 10 illustrate views of a person maneuvering between a wheelchair and a surface utilizing the apparatus of the present invention;

FIGS. 11 through 14 illustrate an additional embodiment of the apparatus of the present invention as used in a bathtub or the like area; and FIGS. 15 through 17 illustrate the apparatus of the present invention being folded into a compact unit for storage; and FIGS. 18 through 27 illustrates a person utilizing the apparatus of the present, invention in a sequential series of steps as the person moves along the steps of the apparatus.

DETAILED DESCRIPTION OF THE INVENTION

Figure 1:
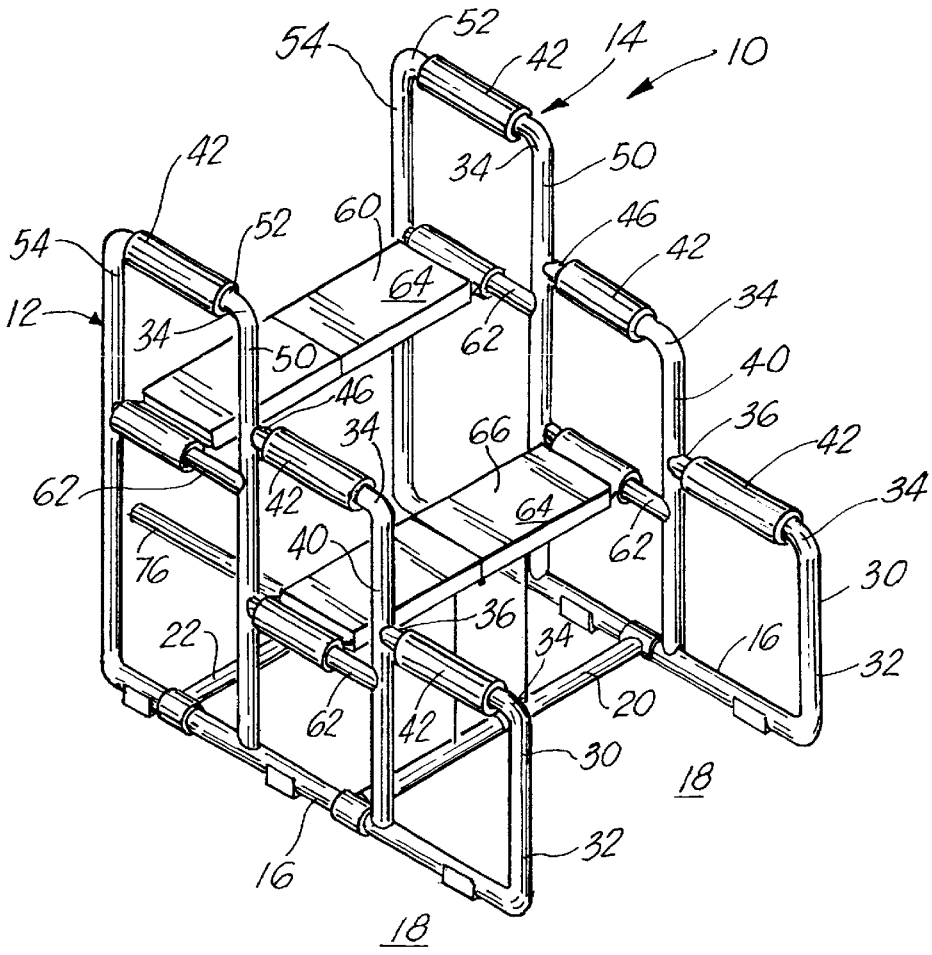
FIG. 1 illustrates an overall view of the preferred embodiment of the apparatus of the present invention.
Figure 3B:
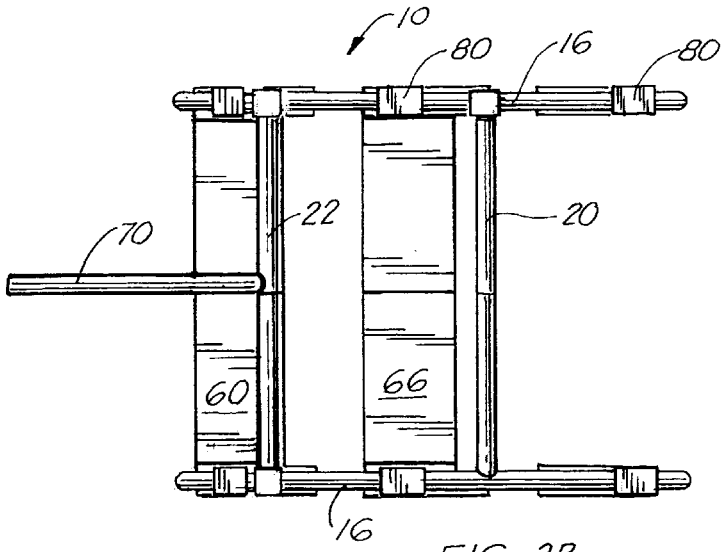
Figure 2B:
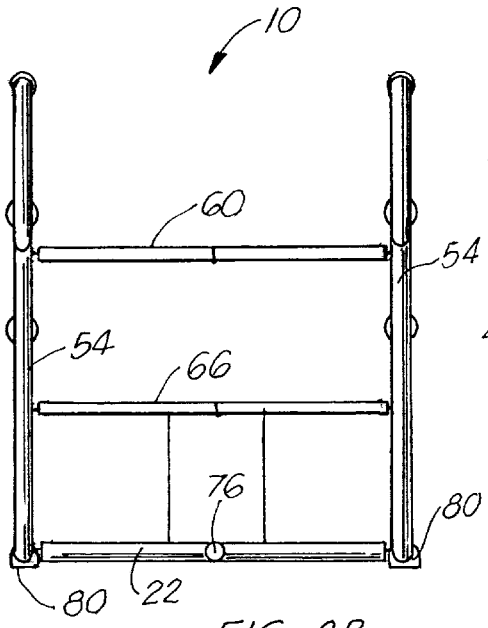
FIGS. 2A and 2B illustrate front and rear views respectively.
Figure 2A:
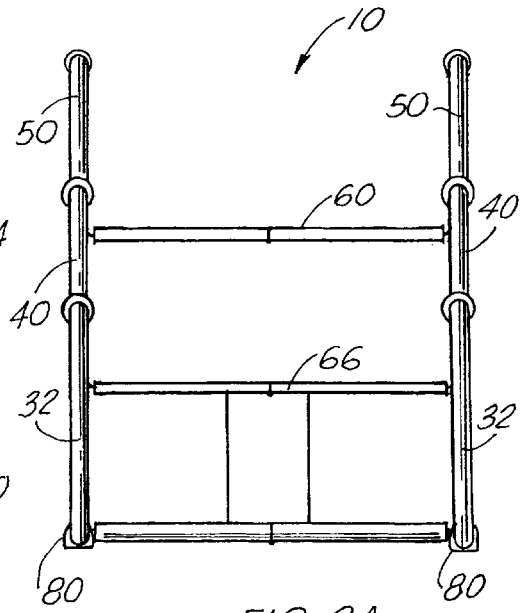

FIGS. 1 through 10 illustrate the preferred embodiment of the apparatus of the present invention by the numeral 10. As illustrated in various views in FIGS. 1 through 4, limited mobility apparatus 10 provides a first upright side portion 12 and a second upright side portion 14. The side portions include a first base member 16 which rests on a surface 18, such as a floor or ground. Each of the base members 16 of side portions 12, 14 are interconnected with a transverse base members 20, 22, which maintain the base of apparatus 10 held firmly on the surface 18. Turning now to the portion of the apparatus above base members 16, there is provided a first pair of lower handle members 30 which is defined by upright portions 32 extending upward from base members 16. Upright portions form a right angle 34, and define a horizontal member 36, which would terminate at the next pair of upright members 40. The members 36 would be provided with a soft cushion material 42, for grasping by a person as will be explained further. Next there is provided a second pair of upright members 40, which also extend upward from base members 16, and form a right angle 34, and define a next higher horizontal handle members 46, also covered with a soft cushion material 42 for grasping. There is next provided a third pair of upright portions 50 which extend upward from base members 16 and form a right angle 34, to define another pair of horizontal members or handles 52, also covered with a soft cushion material 42, for grasping by a person using the apparatus. The members 52 would terminate in the rear most pair of members 54 which extend down to base members 16 and define the rear of the apparatus 10. For purposes of stability, there is illustrated the foot pads 80 engaged between the lower base members 16 and the surface 18, and for rear stability, there is included a bar 76 extending rearwardly from lower frame 22, so that the apparatus does not tilt rearward as a person is moving off or on the apparatus 10.

As seen further in the Figures, there is provided a plurality of steps positioned between upright members 12, 14. First upper step 60 extends between upright members 12, 14, and is positioned below the highest handles 52. Step 60 is supported by a pair of members 62 on each frame 12, 14, and includes a flat surface 64 for a person to rest upon. There is provided a second lower step 66, likewise supported on members 62 on each frame 12, 14 and including a flat surface 64 for a person to rest upon. Although there is no lowest most step on the apparatus 10, for purposes of use, the surface 18 will serve as the lowest most step. As seen, each pair of handles 36, 46 and 52 are associated and will be used in conjunction with each step, as will be explained in relation to FIGS. 5 through 10.

Figure 5:
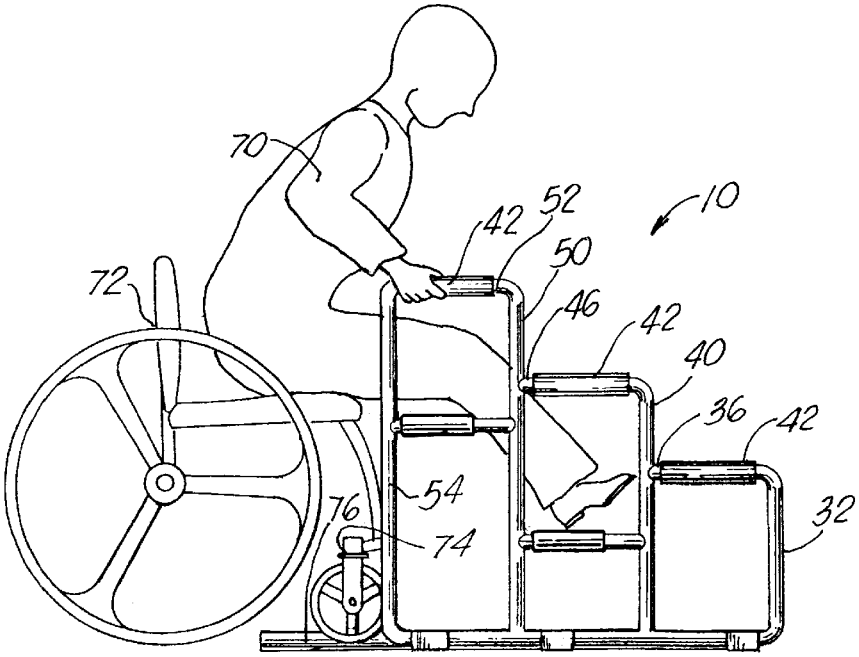
Figure 6:
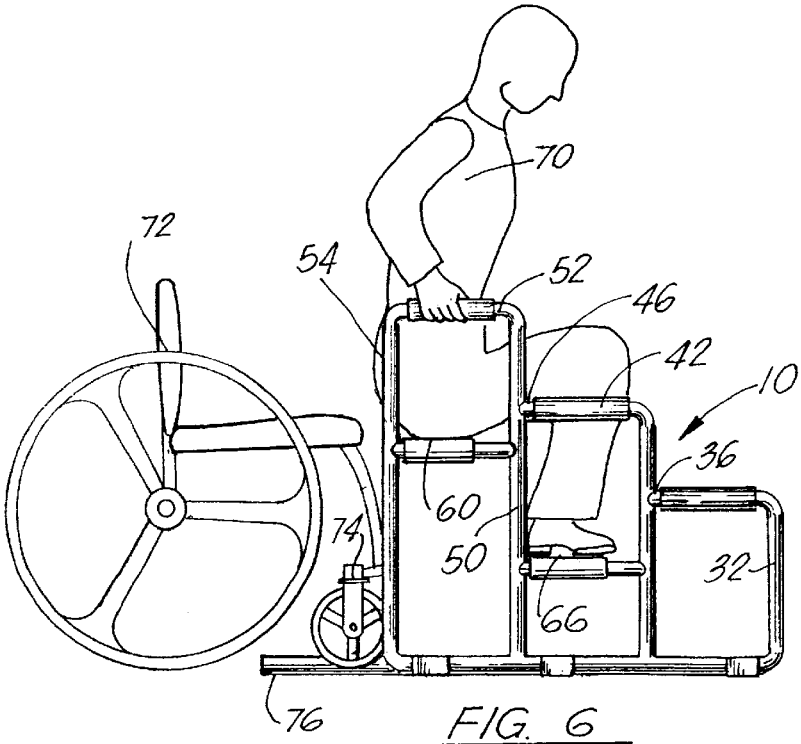
Figure 9:
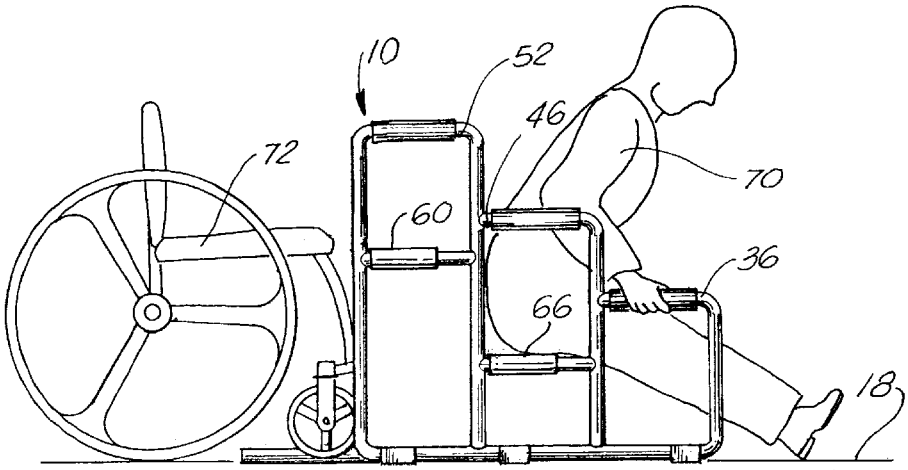
Figure 10:
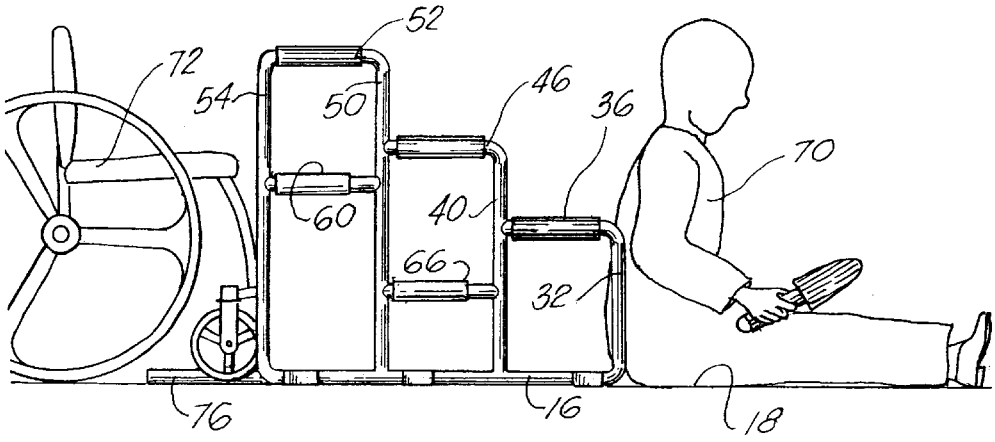

As seen in FIGS. 5 through 10 in sequential fashion, a person 70 has positioned a wheelchair 72 along the rear upright member of the apparatus 10, and has secured the chair 72 in place to the apparatus 10 through a VELCRO strap or the like 74. At this point, the person 70 would grasp each upper handle 52 above upper step 60, and with very little effort raise one's backside from the chair 72, onto upper step 60, without the use of one's legs, as seen in FIGS. 5 and 6. Once in position, as seen FIG. 6, the person, by grasping handles 46 would lower his body to the next lower step 66, as seen in FIGS. 7 and 8. Once this is accomplished, the person would grasp the handles 36, and lower himself down to the lowest point, or surface 18, as seen in FIGS. 9 and 10. For purpose of explanation, the surface 18 may be the floor, or the ground or whatever base surface the person may wish to descend to in order to accomplish a work or play task.

In order to return to the wheelchair, the person 70 would simply repeat the steps in reverse. While seated on surface 18, the person would grasp handles 36 and raise himself from surface 18 to lowest step 66, then grasp handles 46 and raise himself to next step 60, simply with the use of the upper body and arm strength of the person. Once the person is on highest step 60, the person would grasp upper handles 52, and move himself back into the seat of the wheelchair The velcro straps 74 could be unfastened, and the wheelchair 72 would be free to move about.

It is foreseen that the ability for a person, such as a paraplegic, who has no or very limited use of his legs, could use the apparatus in the manner described above, or in the event of an emergency. For example, if the person fell from his chair 72 and is unable to pull himself directly from the surface 18 onto the chair 72 due to the difficulty in going to such a height using only arm strength. However, the person could pull himself along the floor 18 and engage the chair 72 to the apparatus 10. Then, he could maneuver himself adjacent the lowest step 66, as seen in FIG. 10, and undertake the procedure described above to return to the chair.

Another embodiment of the apparatus 10 is seen in FIGS. 11 through 14, and addresses primarily the type of user, such as the elderly, who may be able to walk, but are unable to move directly into a seated position, for example in a bath tub 100. In this particular embodiment, the apparatus 10 has been modified, if necessary, to rest upon the floor 102 of the tub 100 as seen in the Figure. So that the apparatus 10 does not move along the tub floor 102, there is provided a member 104 along the rear of the apparatus which would slidably engage into an opening 106 in a bracket 108 which has been secured above the wall 110 of the tub 100. Once the apparatus 10 is secured in place, the person would simply climb into the tub 100, sit on the most convenient step of apparatus 10, and with hands on the appropriate handles work himself down each step until the person is seated in the tub 100. This manner in which a person would be seated can been seen in the sequential series of drawing 18 through 27 which illustrates a person, who is, able to walk perhaps but cannot move from a standing position to a sitting position would be able to utilize the apparatus in a bathtub 100 in the manner as illustrated in those Figures.

Following the bath, and as illustrated in FIGS. 18 through 27, the person would face rearward to the first step 66, and by grasping handles 36 above step 66, move himself onto the first step and each subsequent step to the level where the person is able to stand within tub 100.

As seen in FIGS. 15 through 17, it is foreseen that the apparatus 10 accomplished with hinges 63, midway along steps 60, 66, and along the transverse base members 20, 22 in such a manner that the steps and base members would be allowed to fold upward in the direction of arrows 90, when being placed in the storage mode. When this occurs, the side members 12, 14 would be pulled inwardly adjacent one another, forming a substantially flat, compact apparatus 10, slidable into a closet, under a bed, or attached to the rear of the chair 72, to be carried by the person. As seen in isolated view in FIG. 17, the apparatus shown in cross section view along lines 17—17 of FIG. 15, wherein there is seen the seat 66, having the ability to fold into the upright position as seen in FIG. 15 by having a collar 69 around the base member 16, and secured to the seat 66, collar 69 secured via an inward depending attachment member 71, which allows the seat 66 to fold internally of the two side members for example 50, so that when the side members 50 are folded in the position as seen in FIGS. 15 and 16, the seats 60 and 66 fold internally of the side members 12, 14 of the apparatus and allowing more compact storage as seen in FIG. 16.

Figure 18:
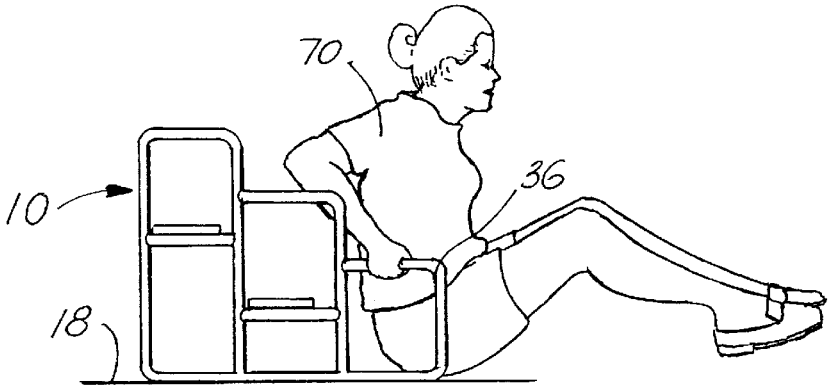
Figure 19:
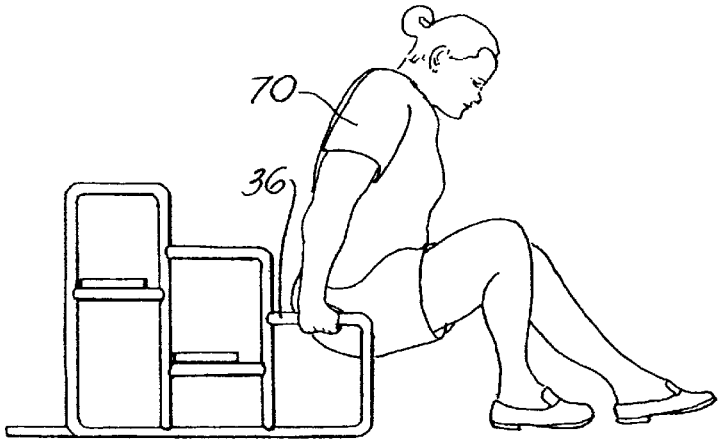
Figure 20:
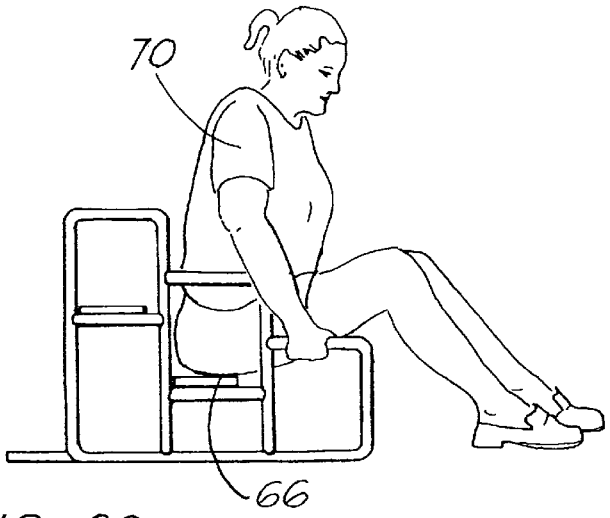
Figure 25:
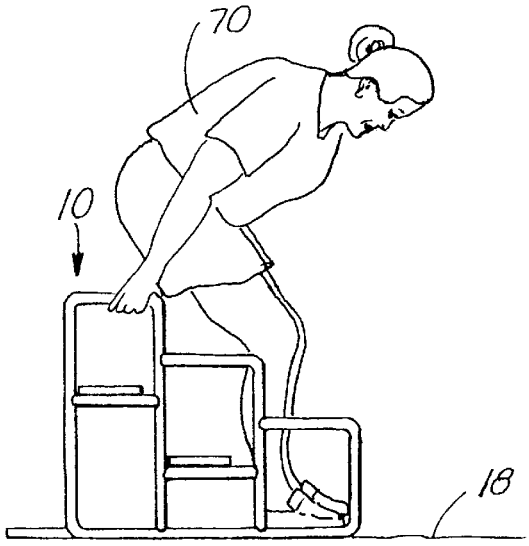
Figure 26:
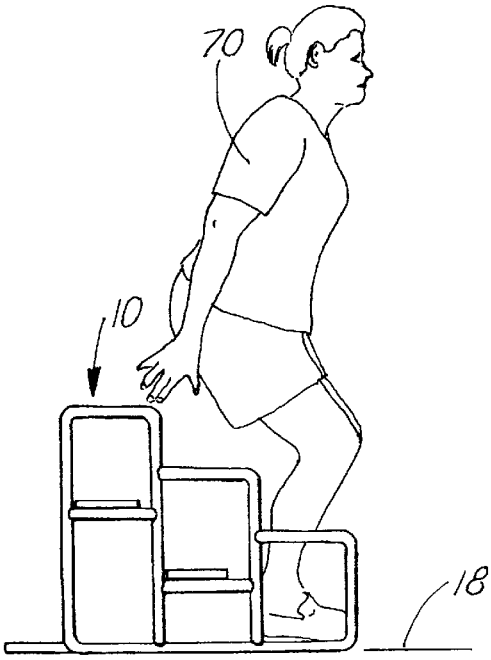
Figure 27:
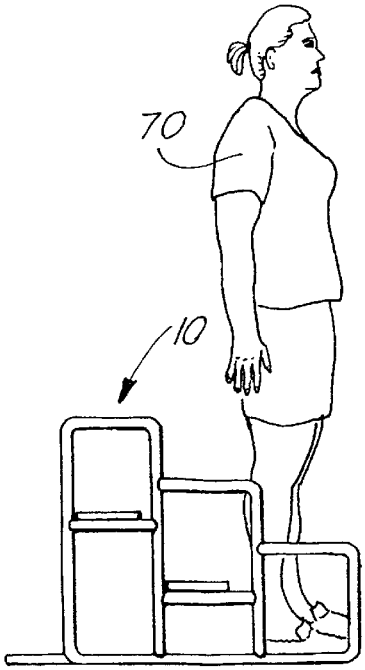

Again, referring to FIGS. 18 through 27, it should be made clear that although the apparatus is intended to be used primarily for paraplegics or other type of people who are unable to walk, it may find a very common and widespread use by a person who is capable of walking, such as an elderly person, yet is unable to move from a standing position to a seated position on the floor or in a flowerbed or on the carpet or on the lawn, etc. As seen in this sequence of FIGS. 18–27, that type of person 70, would be able to utilize this apparatus by simply placing it on the floor or on the surface 18, and going through the series of steps as follows: As seen in FIG. 18, the person 70, is seated on the surface 18 grasping apparatus 10, at handle 36. The person 70 would lift ones self as seen in FIG. 19 and then move to the first step 66, as seen in FIG. 20. Following that movement reference is made to FIG. 21 where the person has then grasped second handles 46, and has lifted ones self up from seat 66, on to seat member 60, as seen in FIG. 22. After this is accomplished reference is made to FIG. 23 where the person has grasped upper handles 52 and while in a seated position pushes himself/herself off of the apparatus 10 as seen in FIG. 24. As seen in FIGS. 25 through 27 the person is now able to lift ones self from a partial standing position to a full standing position as seen in FIG. 27. Of course should a person wish to go from the fully standing position as seen in FIG. 27 to the fully seated position on surface 18 as seen in FIG. 18, the person would simply go through a reversal of the steps as was discussed in regard to FIGS. 18 through 27. That is, the person would go through the steps in the reverse that is starting FIG. 27 and terminating at FIG. 18.

This apparatus 10 is foreseen to have very broad applications. Although paraplegics would benefit greatly from such an apparatus for moving in and out of a wheelchair, onto a surface, such as the floor, or onto the lawn, to work in a garden, people who are unable to move around, such as the elderly or injured, would benefit from the use of the apparatus. The apparatus could be constructed of lightweight tube aluminum, similar to the type used with walkers, or other lightweight material or some type of a composite material, and could be fabricated in different sizes, heights and widths, depending on the size of the individual utilizing the apparatus.

The foregoing embodiments are presented by way of example only; the scope of the present invention is to be limited only by the following claims.

What is claimed is:

1. A ladder apparatus for use by individuals with limited mobility comprising:

(a) first side frame;

(b) a second side frame;

(c) a plurality of steps positioned between the first and second side frames;

(d) handle members positionable above each of the steps for providing a means for a person to grasp the handle members while seated and move to the next highest or lowest step through the use of the upper limbs until the person has reached a desired level; and (e) means for engaging the highest step of the apparatus to a wheelchair so that a person may move between the wheelchair and the apparatus.

2. The ladder apparatus in claim 1, further comprising a frame support between the first and second side frames.

3. The ladder apparatus in claim 1, further comprising hinged engagement on the steps so that the apparatus may be folded from a first useable position to a second folded position for storage.

4. The ladder apparatus in claim 1, wherein the handles are positioned in relation to the steps so that a person is able to maneuver up or down the steps while faced rearward to the handles on the next highest or lowest step.

5. The ladder apparatus in claim 1, wherein the side frames would be constructed of lightweight material, including aluminum and composite metallic material.

6. A ladder apparatus for use by individuals with limited mobility, such as a paraplegic, comprising:

(a) a first side frame;

(b) a second side frame;

(c) a plurality of steps positioned between the first and second side frames;

(d) handle members positioned above each of the steps for providing a means for a person to grasp the handle members while seated and move to the next highest or lowest step through the use of the upper limbs until the person has reached a desired level;

(e) means for allowing the apparatus to be configured from a first open and useable position to a second closed position for storage; and (f) means for engaging the highest step of the apparatus to a wheelchair so that a person may move between the wheelchair and the apparatus.

7. The ladder apparatus in claim 6, wherein the side frames are constructed of a lightweight material, including aluminum and composite metallic material.

8. The ladder apparatus in claim 6, further comprising a frame member extending rearwardly from the highest step to provide a means for a paraplegic to move from a wheelchair to the apparatus and return to the wheel chair.

9. The ladder apparatus in claim 6, the means to configure the apparatus between open and closed positions comprises hinges along each of the steps to allow the steps to be folded upward allowing the side frames to be brought together in the closed position.

10. A ladder apparatus for use by individuals with limited mobility, for moving from a standing position to a seated position in a bath tub, the apparatus comprising:

(a) a first side frame;

(b) a second side frame;

(c) a plurality of steps positioned between the first and second side frames;

(d) handle members positioned above each of the steps for providing a means for a person to grasp the handle members while seated and move to the next highest or lowest step through the use of the upper limbs until the person has reached a desired level; and (e) means for securing the apparatus in the bathtub, so that the person may be seated on the highest step and move down to the level of the tub, and upon completing a bath, move upward from the tub, through the plurality of steps to the highest step, for returning to the standing position.

* * * * *